United States Patent [19]

Frantz et al.

[11] 4,383,571

[45] May 17, 1983

[54] DUMMY BAR FOR CONTINUOUS CASTING EQUIPMENT

[75] Inventors: David W. Frantz, Allen Park, Mich.; Louis Lazaretti, Badden, Pa.

[73] Assignee: Gladwin Corporation, Detroit, Mich.

[21] Appl. No.: 244,253

[22] Filed: Mar. 16, 1981

[51] Int. Cl.[3] ..... B22D 11/08

[52] U.S. Cl. ..... 164/446; 164/426

[58] Field of Search ..... 164/425, 426, 445, 446, 164/483

[56] References Cited

U.S. PATENT DOCUMENTS

| | | | |
|---|---|---|---|
| 3,305,899 | 2/1967 | Saunders | 164/445 |
| 3,521,697 | 7/1970 | Niskovskikh | 164/445 |
| 3,603,375 | 9/1971 | Lauterbach | 164/445 |
| 3,633,653 | 1/1972 | Lyman | 164/445 |
| 4,215,740 | 8/1980 | Scheurecker | 164/446 |

*Primary Examiner*—Gus T. Hampilos
*Assistant Examiner*—Peter Martine
*Attorney, Agent, or Firm*—Cullen, Sloman, Cantor, Grauer, Scott and Rutherford

[57] ABSTRACT

An elongated dummy bar has one end secured to a closure plug arranged within an open ended, continuous casting mold for supporting the plug within the mold and for endwise movement for removing the plug from the mold and guiding it along a curved path away from the mold. Molten metal cast in the mold forms a continuous cast strand whose lead end joins to the closure plug so that endwise movement of the bar and plug guides the cast strand along the curved path. The bar is formed of parallel rows, of rigid links which are arranged end to end. Pivot pins transversely extend across all the rows between the adjacent ends of the links. The pins are pivotally journalled within opposing sockets formed in the facing ends of adjacent links in each row. Flexible cables are arranged between and parallel to the rows of links and pass through openings extending diametrically through the pins. The flexible cables are tightly secured to the opposite ends of the dummy bar under sufficient tension to apply a compressive force upon the rows of links. Thus, the links are held against their pivot pins, but may pivot to a limited extent about their respective pivots for bending the bar as the bar moves endwise in the curved path.

9 Claims, 12 Drawing Figures

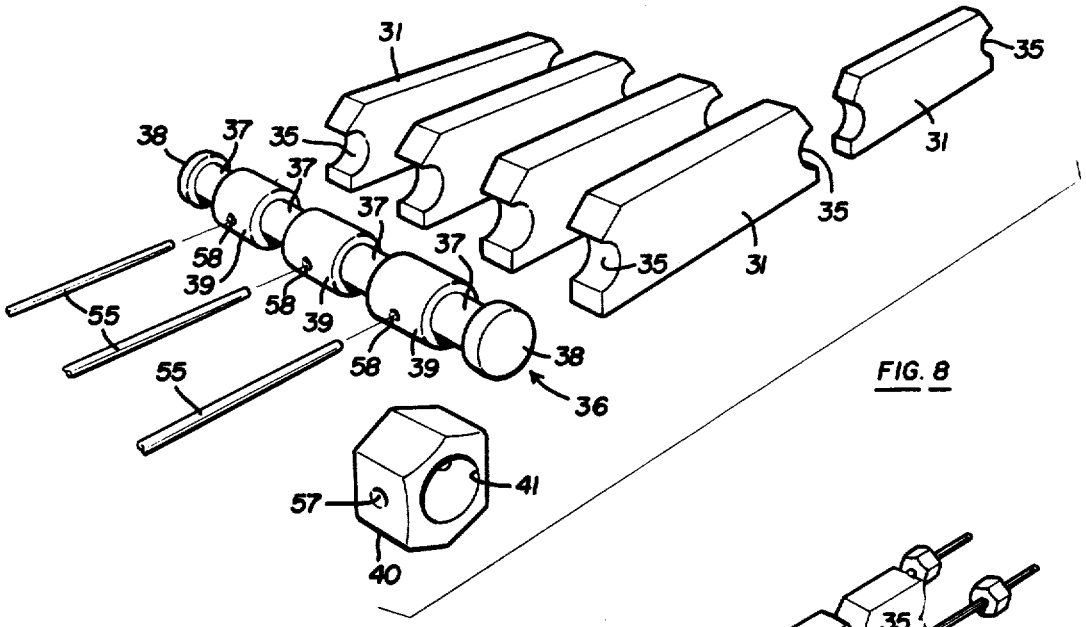
FIG. 8
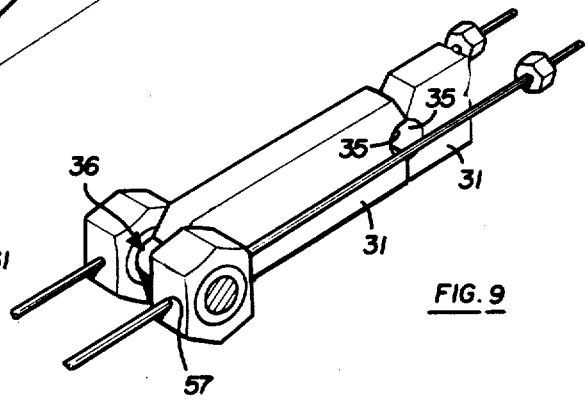
FIG. 9
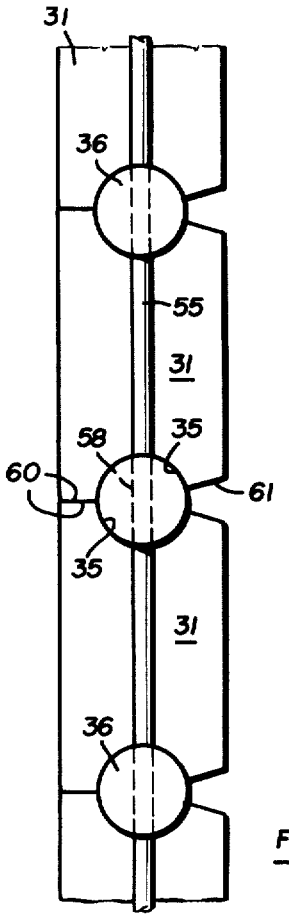
FIG. 10
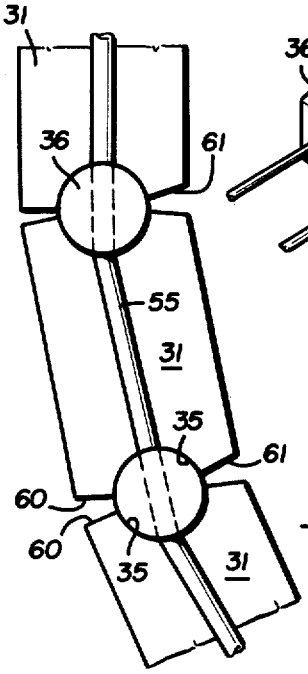
FIG. 11
FIG. 12
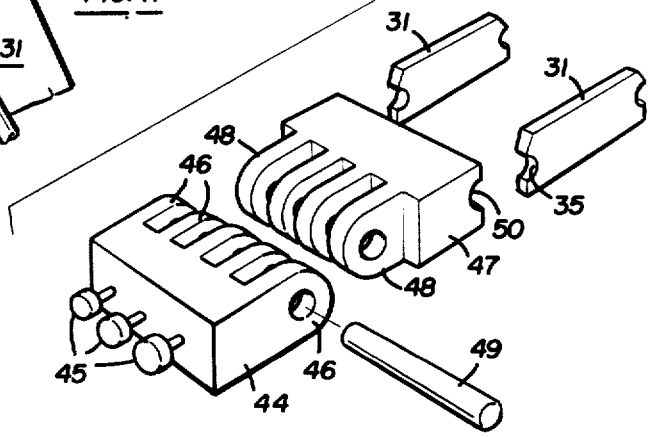

DUMMY BAR FOR CONTINUOUS CASTING EQUIPMENT

BACKGROUND OF INVENTION

This invention relates to an improved flexible dummy bar used in continuous casting equipment. Examples of dummy bars and their use are disclosed in U.S. Pat. No. 3,442,322 issued May 6, 1969 to Lemper and U.S. Pat. No. 3,581,808 issued June 1, 1971 to Vertesi and Phillips.

In the conventional continuous casting process for producing continuous strand or slab from steel and the like, molten metal is poured into the open top of a mold which also has an open bottom. The metal solidifies against the cooled interior walls of the mold to form a solidified skin surrounding a molton core. The solidifying strand emerges from the lower end of the mold and is guided away from the mold. From the time the strand leaves the mold, cooling continues so that the core ultimately solidifies. Then, the strand is cut to lengths for further processing.

The conventional process involves gravity pouring the molten metal downwardly into the open upper end of the mold, withdrawing the partially solidified strand downwardly, and gradually curving the strand along an arc until it continues in a horizontal direction for cutting. The movement of the strand along the arc involves guiding the strand with appropriate rollers. The above mentioned patents illustrate the strand movement and the general procedure involved.

When the casting operation begins, the lower end of the mold must be temporarily plugged to prevent the molten metal from simply running through it. That is, the molten metal must be retained within the mold for a sufficient period of time to begin the solidification. Thereafter, the plug can be removed.

Conventionally, the types of plugs used are positioned within the mold and held in place by a "dummy bar". This is an elongated strip having an end fastened to the mold plug. The strip extends between the rollers used to guide and pull the strand which exists from the mold. An endwise pulling force on the dummy bar withdraws the plug from the mold and moves the plug along the arcuate path. Since, the lead end of the strand interlocks with the plug, the strand follows the plug and dummy bar movement along the arcuate path.

In general, prior dummy bars comprise an elongated strip that can be bent into an arcuate curve while the dummy bar is pulled longitudinally for pulling and guiding the plug with the attached lead end of the cast strand. Such strips are formed of interconnected sections. Thus, because of manufacturing tolerances, looseness of connection means, etc., there is an inherent, limited, relative movement between bar sections. This presents a problem.

Ordinarily, the plug is held within the mold by a generally vertically arranged portion of the dummy bar. Consequently, that portion of the dummy bar acts like a support column upon which the plug rests. Hence, the weight of the plug, along with the weight of the incoming molten metal, comprises the dummy bar downwards. This presses the dummy bar sections rigidly together to eliminate looseness at connections. However, when the dummy bar is pulled longitudinally, the usual tolerances or spaces between the sections and their connections cause a momentary expansion or elongation of the dummy bar until the dummy bar sections stabilize in their longitudinal movement. The effect is similar to a railroad engine pulling a train from a stationary start.

The rapid momentary elongation of the dummy bar permits the plug to suddenly drop down a short distance. That drop can cause rupturing of the still thin, solidifying skin on the strand to produce a "breakout" or release of the molten core through the solidified skin.

Consequently, it is desired to have a dummy bar which does not change length when pulled despite having the usual tolerances or looseness inherent in manufacturing a large, elongated, multiple part device of this kind. The invention herein relates to such an improvement in dummy bar construction, i.e., one wherein the bar is flexible to a limited degree for guiding the plug and strand around a curve, but nevertheless, which does not change length or become loose in endwise movement in either direction.

SUMMARY OF INVENTION

The invention herein contemplates forming a flexible dummy bar made of parallel rows of transversely aligned links with transverse pivot pins extending across all of the rows between the adjacent ends of each pair of links. Each link is provided with an endwise opening, semi-circular, pin receiving socket on its opposite ends. In addition, flexible cables are arranged between the rows and extend through openings in the pins. The cables are tightened at their end so as to provide compressive longitudinal forces on each of the rows of links to tightly compress the links against the pins arranged with the link sockets. Consequently, each row of links is normally in compression so that there is no slack or looseness between the interfitting links and pins. In that way, whether the dummy bar is pushed or pulled longitudinally, its length is unchanged. This avoids sudden movements of or dropping of the plug.

An object of this invention is to form a dummy bar out of elements which are relatively simple to construct, which easily fit and connect together, and are inexpensive to make, maintain and replace when necessary. Because the dummy bar ordinarily is guided around the arc of movement of the cast strand through the conventional guide and pinch rollers that grip and guide the strand, the dummy bar elements must be of a size and shape to properly fit between and coact with the rollers. Because of the hostile environment in which the bar is used, the bar elements must resist damage to or from the rollers.

Another object is to provide a dummy bar which can be arranged, at least in part, vertically to support the mold plug and molten metal within the mold, but, when pulled longitudinally, will not increase in length momentarily due to looseness or tolerances.

These and other objects and advantages of this invention will become apparent upon reading the following description, of which the attached drawings form a part.

DESCRIPTION OF DRAWINGS

FIG. 8 is a perspective, disassembled view of a number of the elements that make up the dummy bar.

FIG. 9 is a perspective view of a portion of the pivot area of the dummy bar.

FIG. 10 is an enlarged, fragmentary view of a portion of the dummy bar with its links arranged in substantially vertical alignment.

FIG. 11 is a fragmentary view, similar to that of FIG. 10, but with the links pivoted relative to each other to show the bending of the dummy bar.

FIG. 12 is a perspective, disassembled view of the mold plug and head portion of the dummy bar.

DETAILED DESCRIPTION

Figure 1:
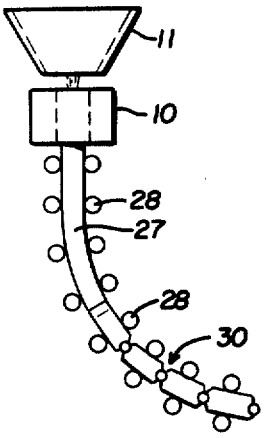
FIG. 1 is a schematic view of a continuous cast strand being guided along its arcuate path by the dummy bar.

FIG. 1 schematically illustrates a typical continuous casting operation used, for example, in continuously casting steel strand. In such a casting operation the strand may vary in size considerably, as for example, a large strand having a width of four feet and a depth of eight inches down to a strand having cross-sectional dimensions of only several inches.

In the continuous casting process, molten metal is poured downwardly into an open top and bottom continuous casting mold 10 from a tundish 11. The molten metal fills the mold cavity 12 to solidify and move downwardly through the mold.

Figure 2:
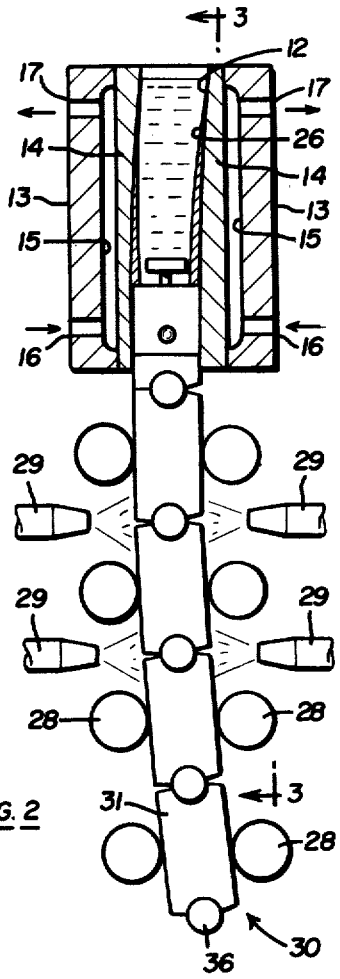
FIG. 2 is an enlarged, partially cross-sectioned, view of the upper end of the dummy bar and the continuous casting mold.
Figure 3:
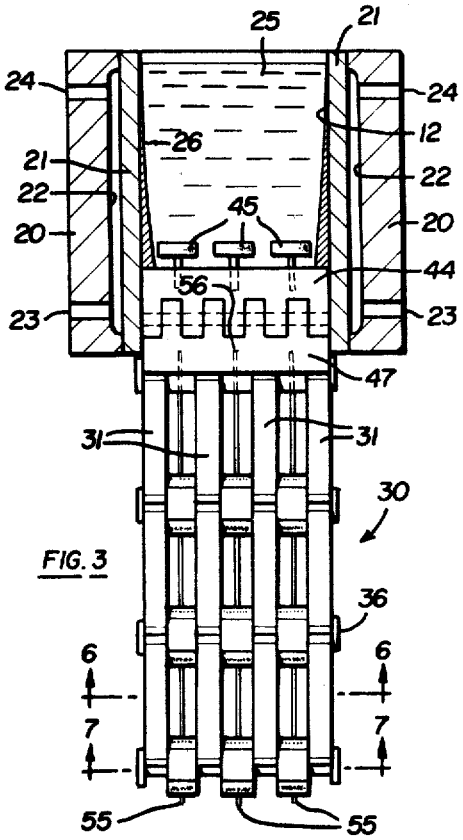
FIG. 3 is a front view of the dummy bar and mold, in cross section, taken in the direction of arrows 3—3 of FIG. 2.
Figure 4:
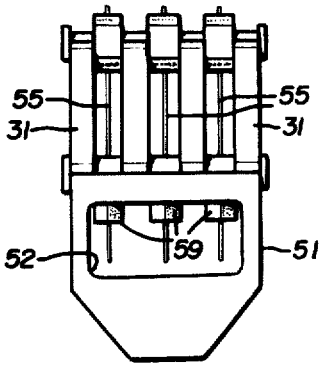
FIG. 4 is a view of the tail or draw end of the dummy bar.
Figure 5:
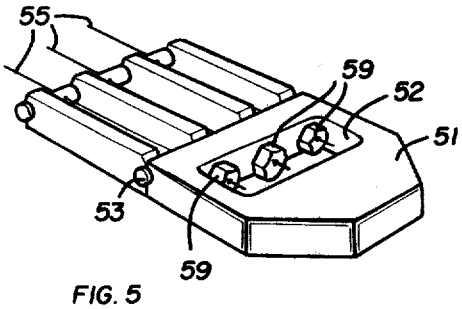
FIG. 5 is a perspective view, to an enlarged scale, of the tail or pull or draw end of the dummy bar.
Figure 6:
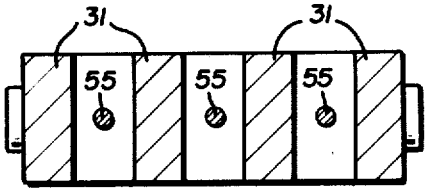
FIG. 6 is an enlarged, cross-sectional view of the dummy bar taken in the direction of arrows 6—6 of FIG. 3.

In a typical mold of the type described, the mold side walls 13 (see FIG. 2) are provided with inner, copper-like liner or face plates 14 against which the metal contacts. Water cooling passageways 15 are formed within the walls, such as grooves formed within the plates or the wall proper. Cooling water is pumped into the passageways through inlets 16 and then removed through outlets 17 for recirculation. Similarly, the end walls 20 of the mold (see FIG. 3) are provided with inner, copper-like face plates or linings 21, behind which are water cooling passageways 22 through which water circulates. The water enters the passageways through water inlets 23 and exits through water outlets 24. Conventional pumping equipment (not shown) is used for circulating the water through the inlets and passageways.

As the metal cools, a thin skin 26 forms where the metal contacts the face plates or linings. The downwardly moving skin gradually thickens so as to form a casing around an interior molten core. At that point, the strand emerges downwardly from the bottom of the mold.

Further movement of the strand 27 is along an arcuate path determined by guide or pinch rollers 28 which guide and pull the strand into a horizontal path. Meanwhile, water spray nozzles 29 apply cooling water upon the exterior surfaces of the strand to continue the cooling so that the molten core solidifies. Upon solidification, the horizontally arranged portions of the strand may be cut to pre-determined lengths for removal and for further processing, as for example, for rolling into sheet.

The dummy bar 30 comprises a number of parallel rows of links 31. The links are the same size and shape, and are aligned, end to end, to form the rows. The number of rows used may vary depending upon the width of the mold, the strength requirements, etc.

Figure 7:
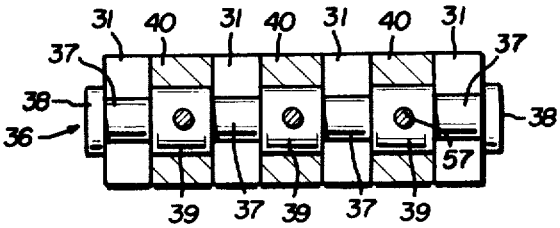
FIG. 7 is an enlarged cross-sectional view taken in the direction of arrows 7—7 of FIG. 3.

Each link is provided with an open, semi-circular socket 35 on its opposite ends. Transverse pins 36 extend across all of the rows between corresponding link ends, as illustrated in FIGS. 7, and 8, for example. These pins are each provided with reduced diameter bearing areas 37 which provide enlarged opposite head-like ends 38 and a number of enlarged spacer support areas 39. Nut-like spacer members 40, having bores 41 are slipped over the pins to ride upon the enlarged spacer support areas 39. The spacers maintain the links in parallelism so as to maintain the longitudinal alignment of the links in each row.

A mold plug 44 (see FIGS. 3 and 12) is normally arranged within the mold to plug it at the time that molten metal is first pured into the mold. This prevents the molten metal from running out through the mold lower end. A number of different kinds of plugs may be used. The particular style or plug construction may vary and thus, the one shown in FIG. 12 is for illustration purposes. The plug illustrated includes bolt-like knobs 45 which extend from the free face of the plug for embedding within the lead end of the strand being cast. In addition, the plug includes hinge leaves 46 which interleaf with the end or head member 46 hinge leaves 48. The leaves are connected together by a suitable hinge pin 49. The opposite end of the head member is provided with a pivot pin socket 50.

The tail or draw end of the dummy bar is provided with a tail member 51 whose size, shape and construction may vary. For illustration purposes, the tail member is indicated as being formed of a large, plate-like member having a tongue-like end which can be grasped by a suitable pulling mechanism. Such mechanisms are conventionally used in connection with dummy bars and therefore, since they form no part of this invention, further description is unnecessary.

The tail member 51 is provided with either one large or a number of small openings 52 and a semi-circular socket 53 for receiving a pivot pin.

Flexible metal cables, such as woven or twisted steel cables 55 are arranged between the rows of links. These cables are each anchored at 56 (see FIG. 3) to the head member 47, such as by welding or by suitable mechanical fasteners. The cables each extend through aligned spacer member holes 57 and diametrically oriented holes 58 formed in the pivot pins 36. The cables also extend through openings formed in the tail member 51 and into the enlarged opening 52 in the tail member 51. Nuts 59, located in the tail member opening 52, may be threadedly secured upon the cable ends by appropriately threading the ends of the cables in a conventional manner. Thus, the nuts 59 may be tightened to uniformly pull all of the cables. The cable tension produces a compressive, longitudinal force on each of the rows of links. By adjusting the nuts evenly, the forces on each row are adjusted to be substantially equal.

In operation, the dummy bar is threaded upwardly through the curved path defined by the rollers 28 until the plug 44 is positioned within the mold 10. Then, molten metal is poured into the mold from the tundish 11 until it fills the mold and the skin 26 begins to form.

As the skin forms and encloses the molten core, the dummy bar is withdrawn endwise so that the plug and gradually emerges downwardly from the mold as more molten metal is poured into the mold.

The bolt-like knobs 45 become imbedded within the lead end of the strand so that, in effect, the dummy bar becomes an extension of the strand. As the dummy bar continues movement along the arcuate path, it leads the strand along with it until ultimately the strand is lead end horizontal. Then, the dummy bar may be freed from the strand by cutting the knobs 45. The removed dummy bar is set aside and used again for the next start-up.

The end of the dummy bar located below the plug acts like a vertical column to support the plug and the weight of the molten metal upon the plug. Actually, the column is slightly curved, since it is conventional to slightly curve the face plates of the mold to begin the arcuate movement of the strand. However, the end portion of the dummy bar, in effect, forms a substantially vertical column support.

In order to maintain the column-like or straight arrangement, the end of each link is cut, on one side of its semi-circular socket, at approximately 90° or normal to the long edge of the link. This forms an abutment 60 on each link (see FIGS. 10 and 11). At the opposite side of its socket, each link end is cut at an obtuse angle portion 61 to provide clearance when the links pivot, as illustrated in FIG. 11. As can be seen, the dummy bar may be bent in one direction only, to a limited degree, for traversing the curved path defined by the rollers. When the dummy bar is bent, as illustrated in FIG. 11, the cables flex or bend at the pins. At all times, whether straight or bent, the cables provide sufficient compressive forces upon the rows of links to keep the link sockets and their pins in tight, but pivotable engagement. Thus, the length of the dummy bar is the same at all times, i.e., it does not expand or enlarge upon pulling the dummy bar.

The links 31 are preferably of sufficient width to closely fit between the guide or pinch rollers 28. The number of rows of links are usually sufficient to simulate the width of the strand being cast. Hence, where powered pinch rollers are used for rolling against and moving the strand, that same action takes place against the dummy bar.

In the event of undue wear or damage to the dummy bar, damaged portions can be easily replaced. For example, damaged links can be easily removed and replaced by releasing the nuts 59 on the cables, to release the tension on the cables, so that the selected links can be removed from their pins and new links to be replaced. Retightening of the nuts 59 restores the dummy bar for use. Consequently, repair is relatively simple. Likewise, since the pivots and sockets form open, journal-like bearings, repair, maintenance and lubrication of these connections can be performed easily.

Having fully described an operative embodiment of this invention, I now claim:

1. A bendable dummy bar for supporting a closure plug within a continuous casting mold and for withdrawing the plug, with the lead end of the continuous cast strand joined to the plug, downwardly from the mold and guiding it in a curved path, comprising:

a row of numerous, rigid, elongated links arranged end to end, with opposite ends of each length having socket forming notches opening endwise of the link;

a transversely arrnaged pin positioned between adjacent ends of each pair of adjacent links and pivotally seated within their sockets so that the links may pivot to a limited degree about the pins;

an elongated, flexible cable extending alongside of, and parallel to, the row of links and extending through diametrically oriented openings formed through each of the pins, with the cable extending the length of the row;

means securing ends of the cable to the opposite ends of the row, with the cable being tightened to apply a compressive force upon the links for keeping the respective link sockets and pins tightly together;

whereby at a bar end portion near the plug, the links may be initially aligned beneath and fastened to the plug to form an upright column-like support for the plug, with said links in substantial axial alignment, and then the bar portion may be endwise moved along a curved path, wherein the links pivot about their pins a limited amount to correspondingly guide the plug and strand along said curved path.

2. A bendable dummy bar as defined in claim 1, and said links being formed of narrow, flat strips, and with the rows of strips being substantially co-planar.

3. A bendable dummy bar as defined in claim 1, and said bar being formed of a plurality of substantially identical rows of links, with the rows being parallel to one another, and the links of one row being transversely aligned with corresponding links in the other rows, and with each of the pins being of sufficient axial length to fit within the sockets of the adjacent links of all of the rows, and with similar cables extending between the rows and extending through corresponding diametrically oriented openings in each of the pins;

and said cable and securing means tightening all the cables substantially equally to place all of the rows under substantially equal compressive forces.

4. A bendable dummy bar as defined in claim 3, and with each link being formed of an elongated, narrow, relatively thin, flat strip, with the links in each row being co-planar, and a transversely extending member connecting together adjacent free ends of the links at the opposite ends of the rows and the cable ends being secured to said transverse members.

5. A bendable dummy bar as defined in claim 4, and including spacer members, of substantially equal thickness, mounted upon each of the pins between adjacent links to separate and hold the links in the adjacent rows in spaced apart position relative to each other.

6. A bendable dummy bar as defined in claim 5, and each spacer member surrounding a portion of its respective pin, and each spacer member having an opening extending through it in alignment with the adjacent cable passing opening of its pin, so that the cables pass through each of the spacers as well as passing through each of the pins.

7. A bendable dummy bar as defined in claim 1, and wherein edges defining each of the link ends on opposite ends of the sockets formed therein are formed with an edge portion from one side of the socket being approximately perpendicular to one long side of the link, and with an edge portion formed on the other side of the socket being at a slightly obtuse angle relatively to the other long side of the link, so that the adjacent pairs of links can be pivoted in one direction from axial alignment when the bar portion formed thereby is straight to a relatively angular relationship for bending the bar.

8. A bendable dummy bar comprising:

a number of parallel rows, each formed of numerous, rigid, elongated links arranged end to end and each made of a relatively thin, flat strip whose opposite ends are formed with approximately semi-circular notches opening endwise of its respective link to form open sockets;

transversely arranged, generally cylindrically shaped pins positioned between adjacent ends of each pair of adjacent links and pivotally seated within their sockets so that the links may pivot to a limited degree about the pins, and with the pins each extending across all of the rows to form a common pivot for all of the rows;

elongated, flexible cables arranged parallel to each of said rows and extending diametrically through openings formed in each of the pins, with the cables extending substantially the full length of the dummy bar;

means for securing opposite ends of the cables to opposite ends of the dummy bar and for tightening the cables substantially uniformly to thereby apply a uniform compressive force upon the links for holding the link sockets and their pins tightly together at all times;

and at least a portion of the end of at least one link of adjacent pairs of links being arranged at an angle relative to the longitudinal axis of the length so as to form a gap between portions of adjacent link ends of sufficient amount to permit the links to pivot relative to each other around their common pin while under the compressive force of the cables;

whereby the dummy bar may be moved in a straight path and alternatively may be endwise moved along a curved path wherein links pivot about their pins a limited amount.

9. A dummy bar as defined in claim 8, and with the end portions of at least one link of each adjacent pair of links being formed to engage with its adjacent link end for maintaining adjacent pairs of links in longitudinal alignment in one position and to permit the links to pivot out of such alignment in one direction only.

* * * * *